US005967742A

United States Patent [19]

Mirsky et al.

[11] Patent Number: 5,967,742

[45] Date of Patent: Oct. 19, 1999

[54] METHOD AND APPARATUS FOR PREVENTING SURGE WHILE TAKING A TURBOCOMPRESSOR OFF-LINE FROM A PARALLEL CONFIGURATION

[75] Inventors: Saul Mirsky; Michael L. Tolmatsky, both of West Des Moines, Iowa

[73] Assignee: Compressor Controls Corporation, Des Moines, Iowa

[21] Appl. No.: 08/996,891

[22] Filed: Dec. 23, 1997

[51] Int. Cl.[6] ..... F04D 27/02; F04B 49/02; F03B 15/00

[52] U.S. Cl. ..... 415/1; 415/17; 415/16; 415/26; 415/28; 415/29; 415/30; 415/36; 415/47; 415/49

[58] Field of Search ..... 415/1, 17, 16, 415/26, 28, 29, 30, 36, 47, 49

[56] References Cited

U.S. PATENT DOCUMENTS 4,046,490 9/1977 Rutshtein et al. ..... 417/28
4,486,142 12/1984 Staroselsky ..... 415/1
4,861,233 8/1989 Dziubakowski et al. ..... 417/201
5,798,941 8/1998 McLeister ..... 364/510

*Primary Examiner*—F. Daniel Lopez
*Assistant Examiner*—Rhonda Barton
*Attorney, Agent, or Firm*—Henderson & Sturm

[57] ABSTRACT

The operation of quickly taking a turbocompressor off-line from a parallel configuration, of a gas pipeline compressor station, may encounter increased mechanical action (in particular, vibration) upon recycle piping and the additional risk of compressor surge. For these reasons, this invention relates to a method and apparatus for decreasing vibratory loads and for increasing surge prevention effectiveness, while initiating an off-line operation, by (1) altering the surge control line's location, at a preset rate, from its initial location to a predetermined new location; and (2) decreasing the turbocompressor's deceleration rate when the operating point intercepts the surge control line before the control line reaches its new location. Upon completion of the off-line activity, the control line returns to its initial location; and the reduction of compressor speed will cease on reaching a preset value.

16 Claims, 5 Drawing Sheets

METHOD AND APPARATUS FOR PREVENTING SURGE WHILE TAKING A TURBOCOMPRESSOR OFF-LINE FROM A PARALLEL CONFIGURATION

TECHNICAL FIELD

This invention relates generally to a method and apparatus for preventing surge while quickly taking a turbocompressor off-line from a parallel configuration of turbocompressors within a gas pipeline compressor station. More specifically, the invention relates to a method that achieves surge prevention by altering (at a preset rate) the surge control line's location; and, if needed, by altering the deceleration rate of the turbocompressor while taking it off-line.

BACKGROUND ART

There are two methods currently employed for taking a turbocompressor off-line from a parallel configuration of a gas pipeline compressor station:

The first method involves fully opening an antisurge (recycle) valve, along with sequentially closing a block valve at the turbocompressor's discharge, and then reducing the turbocompressor's rotational speed.

The second method involves decreasing the turbocompressor's rotational speed while its antisurge controller is operating automatically. The recycle valve is then opened, based upon the antisurge controller's requirement to keep the turbocompressor's operating point on the surge control line.

A disadvantage of the first method is the onset of increased mechanical action (in particular, vibratory) upon recycle piping. This is due to the flow rate of gas (passing through a fully opened recycle valve) being significantly larger than the flow rate needed to prevent surge. A disadvantage of the second method is the low decreasing-rate of turbocompressor rotational speed required for surge prevention—that is, the antisurge controller is set to open the recycle valve when the operating point is close to the surge limit line, and the controller's speed-of-action is limited by conditions of control-system stability. This reduced deceleration rate of the turbocompressor being brought off-line diminishes the effectiveness of a station's overall control.

DISCLOSURE OF THE INVENTION

The purpose of this invention is twofold: (1) shorten the time required to take a compressor off-line, and (2) reduce the risk of high mechanical loads (particularly vibration) on recycle piping during compressor deceleration. The emphasis of this technique is directed to turbocompressors used in gas pipeline compressor stations; although the method has applications with other types of turbocompressor groups.

This method proposes moving the surge control line of an antisurge controller to a predetermined new location farther from the surge limit line while the compressor is being decelerated. When it is established that the compressor has been successfully taken off-line, the surge control line is returned to its initial location at a preset rate. If, however, a compressor's operating point reaches (intercepts) the control line before the control line reaches its new location, the compressor's deceleration rate is reduced as a function of (1) that distance from the initial location (before deceleration) to the control line's current location where the operating point intercepts it, and (2) that distance from the initial location (before deceleration) of the control line to its predetermined new location.

Completion of an off-line operation can be indicated by (a) a difference between the discharge pressure of the compressor brought off-line and the common discharge pressure of the remaining compressors, (b) a position of the recycle valve, (c) compressor rotational speed, or (d) the expiration of a time period. Upon completion of the off-line operation, a signal may be generated to indicate to the antisurge controller that its surge control line may be returned to its initial location. In accordance with this method, the reduction of compressor rotational speed will cease upon reaching a predefined value.

BEST MODE FOR CARRYING OUT THE INVENTION

Although this invention is applicable to various types of turbocompressor groups, its focus is directed to gas pipeline compressor stations in which all compressors (arranged in parallel) share common suction and discharge headers. In addition, each compressor is equipped with an antisurge valve and an antisurge controller that modulates that valve. The drivers (gas turbines) for the compressors are each equipped with a fuel control valve and a rotational speed controller.

Figure 1:
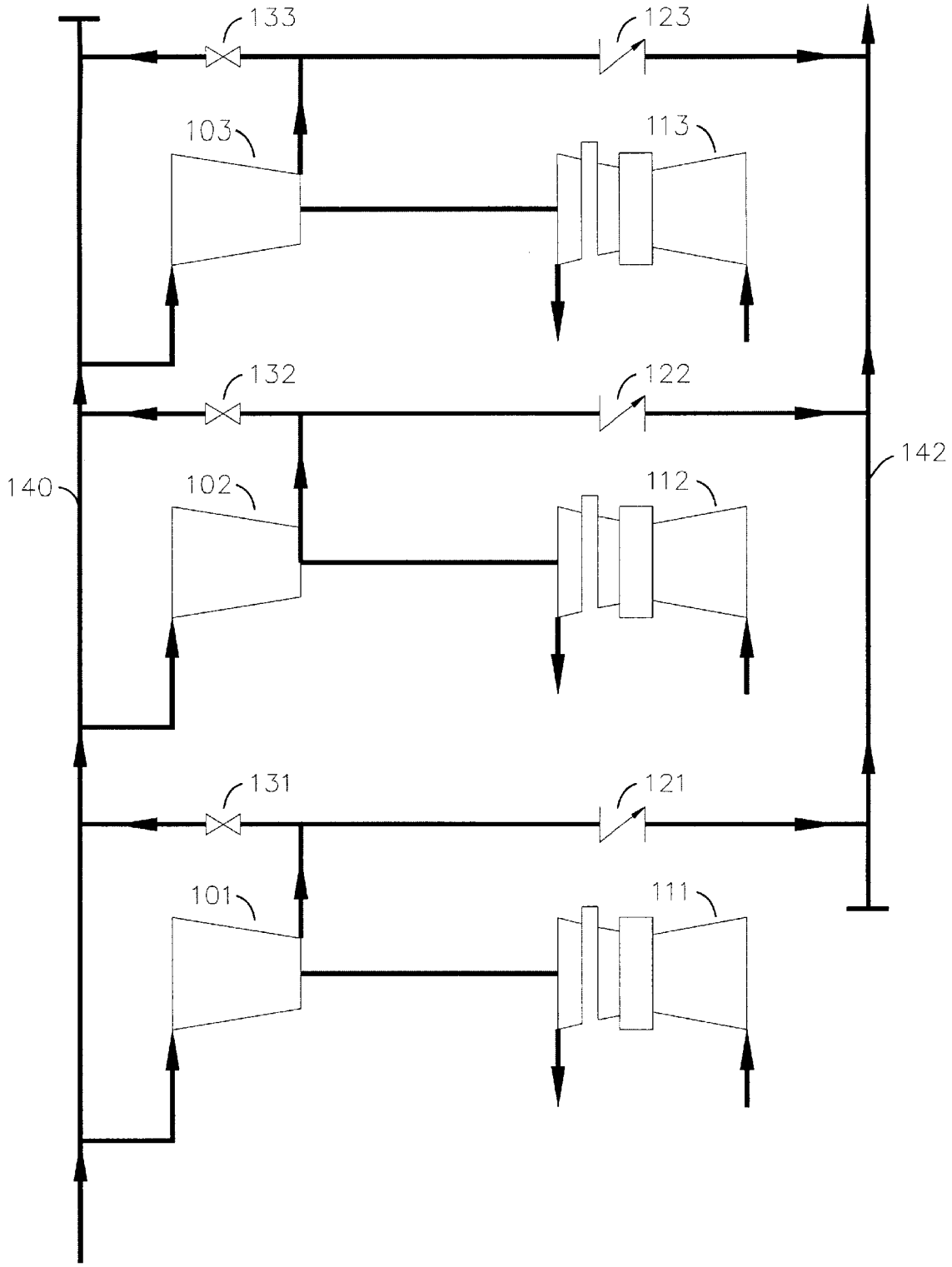
FIG. 1 shows a parallel configuration comprising three turbocompressors.

A representation of a parallel turbocompressor arrangement is shown in FIG. 1 and consists of three compressors 101, 102, 103 with accompanying drivers (gas turbines) 111, 112, 113. Each compressor-driver unit is equipped with a check valve 121, 122, 123 and a recycle valve 131, 132, 133; moreover, these three units commonly share a suction header 140 and discharge header 142.

Figure 2:
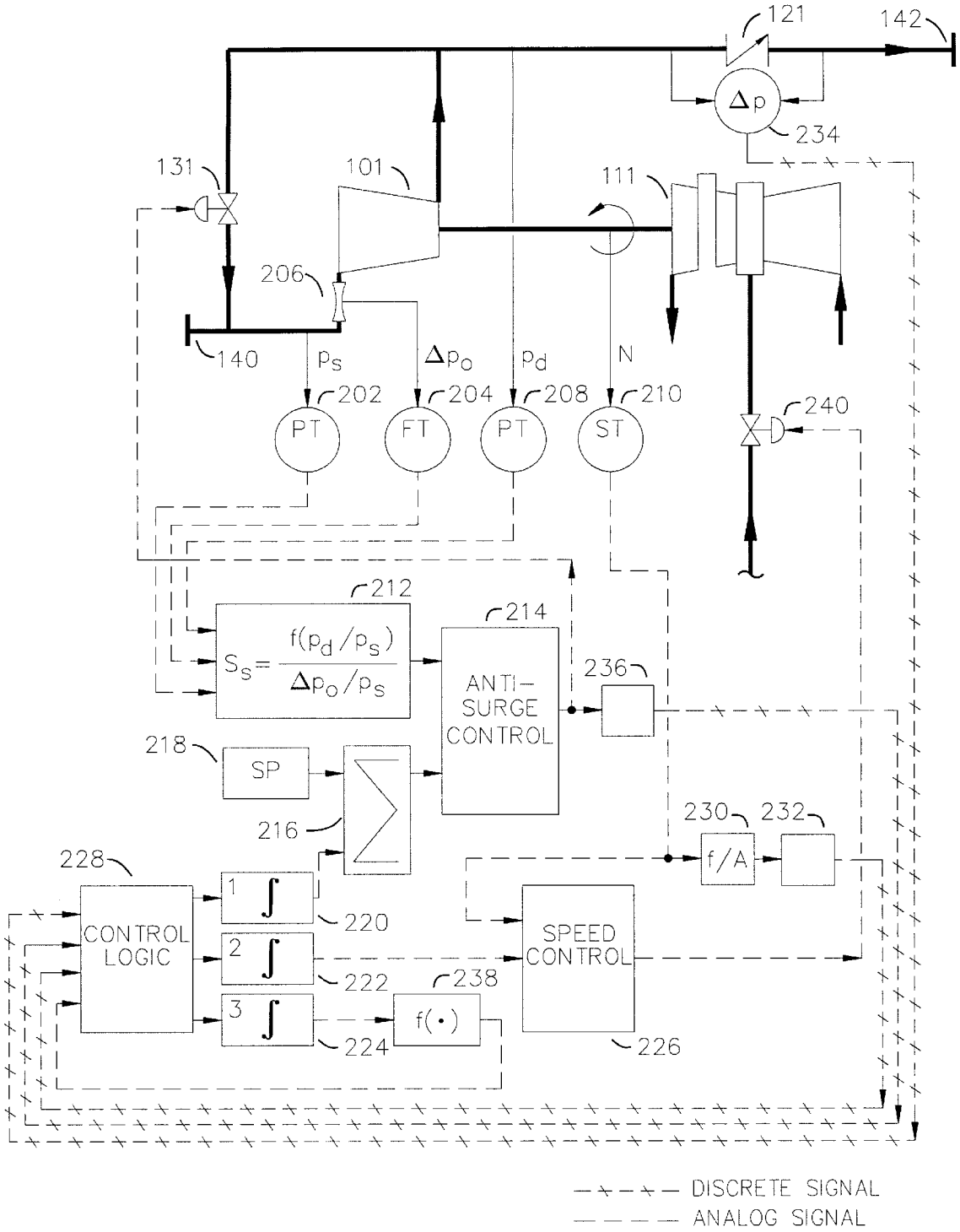
FIG. 2 shows a functional diagram of a turbocompressor control system.

FIG. 2 shows a functional diagram of a compressor-driver unit comprising a compressor 101 and a driver 111 (as depicted in FIG. 1). This unit is equipped with a suction-pressure transmitter (PT-$p_s$) 202, a differential-pressure transmitter (FT-$\Delta p_o$) 204 for a flow measuring device 206, a discharge-pressure transmitter PT-$p_d$) 208, and a rotational speed transmitter (ST-N) 210. Transmitters PT-$p_s$, FT-$\Delta p_o$, and PT-$p_d$ are connected to a computation block 212 that calculates an antisurge control variable which can take on several forms, for instance $$S_s = \frac{Kf(p_d / p_s)}{\Delta p_o / p_s}$$

and then inputs this variable to an antisurge controller 214 which is also inputted by a summing block 216 that receives signals from a predefined set point (SP) 218 and from the first of three integrators 220, 222, 224.

The speed transmitter (ST-N) 210 sends a signal to a speed controller 226 and, indirectly, to a logic controller 228 by way of a frequency-analog signal converter 230 and a speed-comparator block 232. A pressure-differential switch (Δp) 234, connected in parallel with a check valve 121, transmits directly to the logic controller 228 which is inputted by two additional signals: the output of a recycle-valve status block 236, and that from a function block 238. The logic controller 228, in turn, outputs to three integrators 220, 222, 224 which, respectively, output to the summing block 216, speed controller 226, and function block 238.

Finally, with all relevant signals received and processed, the antisurge controller 214 and the speed controller 226 coordinate their specific tasks to shorten the time required to take the turbocompressor off-line, as well as to lessen the mechanical loads on the recycle piping by the following actions:

After processing the inputs from both the computation block 212 and the summing block 216, the antisurge controller 214 transmits to the recycle valve 131 and, concurrently, to the recycle-valve status block 236.

After processing inputs from both the rotational-speed transmitter 210 and the second integrator 222, the speed controller 226 transmits to a final control element 240.

Figure 3:
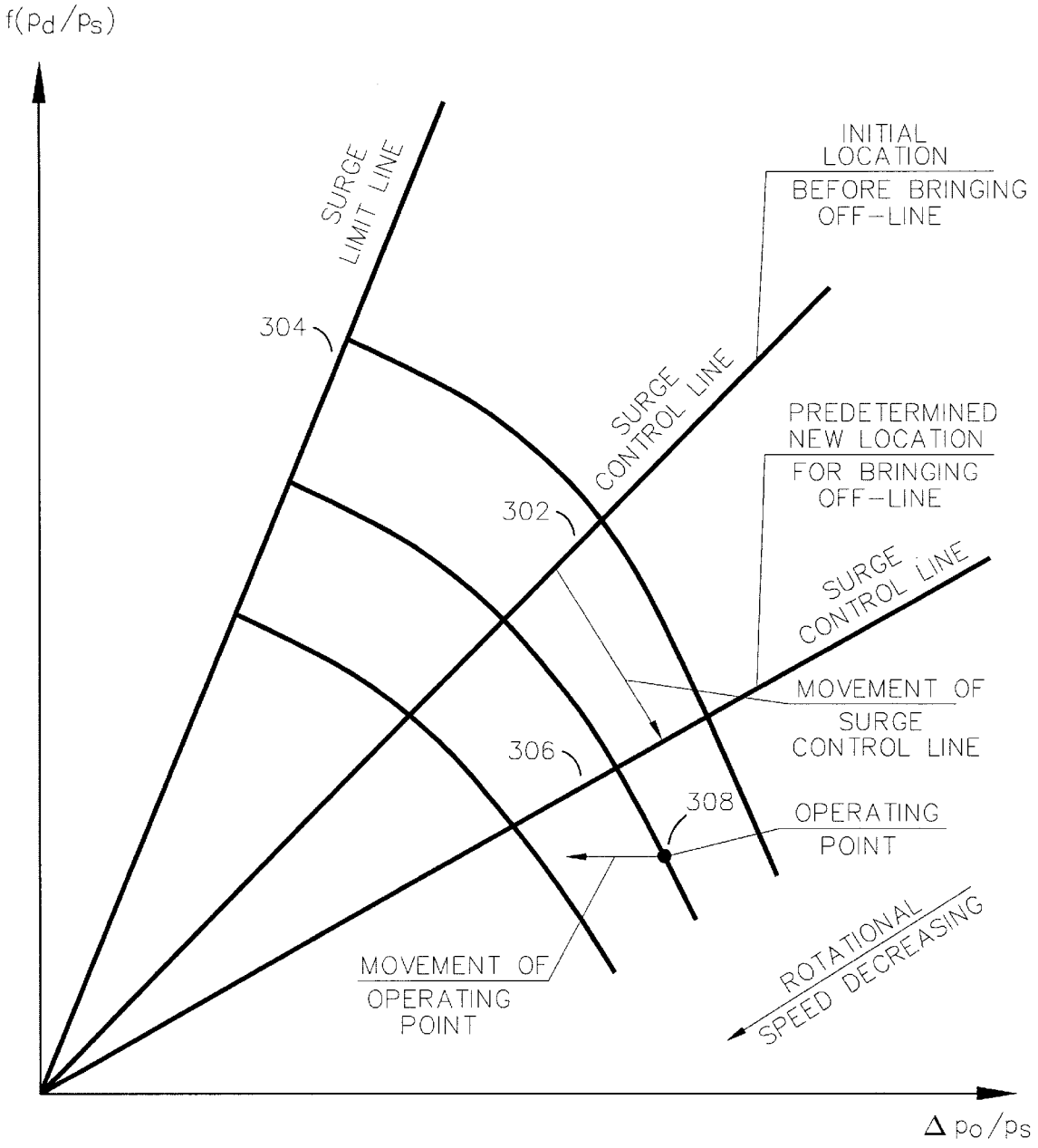
FIG. 3 shows a compressor map.

The following section describes the operating procedure of the proposed method, as illustrated by the functional diagram, FIG. 2. Once the process of bringing a compressor off-line is initiated, the logic controller 228 outputs are transmitted to three integrators 220, 222, 224 whose output signals are changed at preset rates. As a result of the first integrator's 220 increasing output signal, and as depicted on the compressor map in FIG. 3, the surge control line 302 begins moving (at a preset rate) to the right of its initial location (away from the surge limit line 304) and toward its predetermined new location 306. Simultaneously, the second integrator's 222 output decreases to a preset value, and the rotational speed set point also decreases. Following this, the compressor's speed diminishes and its operating point 308 moves left (because of the constant relation, $P_d/P_s$) in the direction of the surge limit line; whereas the surge control line continues to move toward its new location and, consequently, toward the operating point.

The computation block 212 calculates an antisurge variable, $S_s$, that characterizes the location of the compressor's operating point relative to the surge limit line, using the following equation in which K is a constant and where $S_s=1$ on the surge limit line:

$$S_s = \frac{Kf(p_d/p_s)}{\Delta p_o/p_s} = 1$$

The recycle valve 131 opens, by way of an antisurge controller 214 Proportional-Integral (PI) response, when the compressor's operating point reaches the surge control line (point-of-interception); that is, when $S=S_s+b=1$. $S \leqq 1$ is the operating point's location relative to the surge control line and b is a safety margin—by increasing the value of b, the distance between the surge control line and the surge limit line is increased.

This procedure can be further described by two scenarios in which a compressor is brought off-line without surging or recycling more than necessary.

Figure 4:
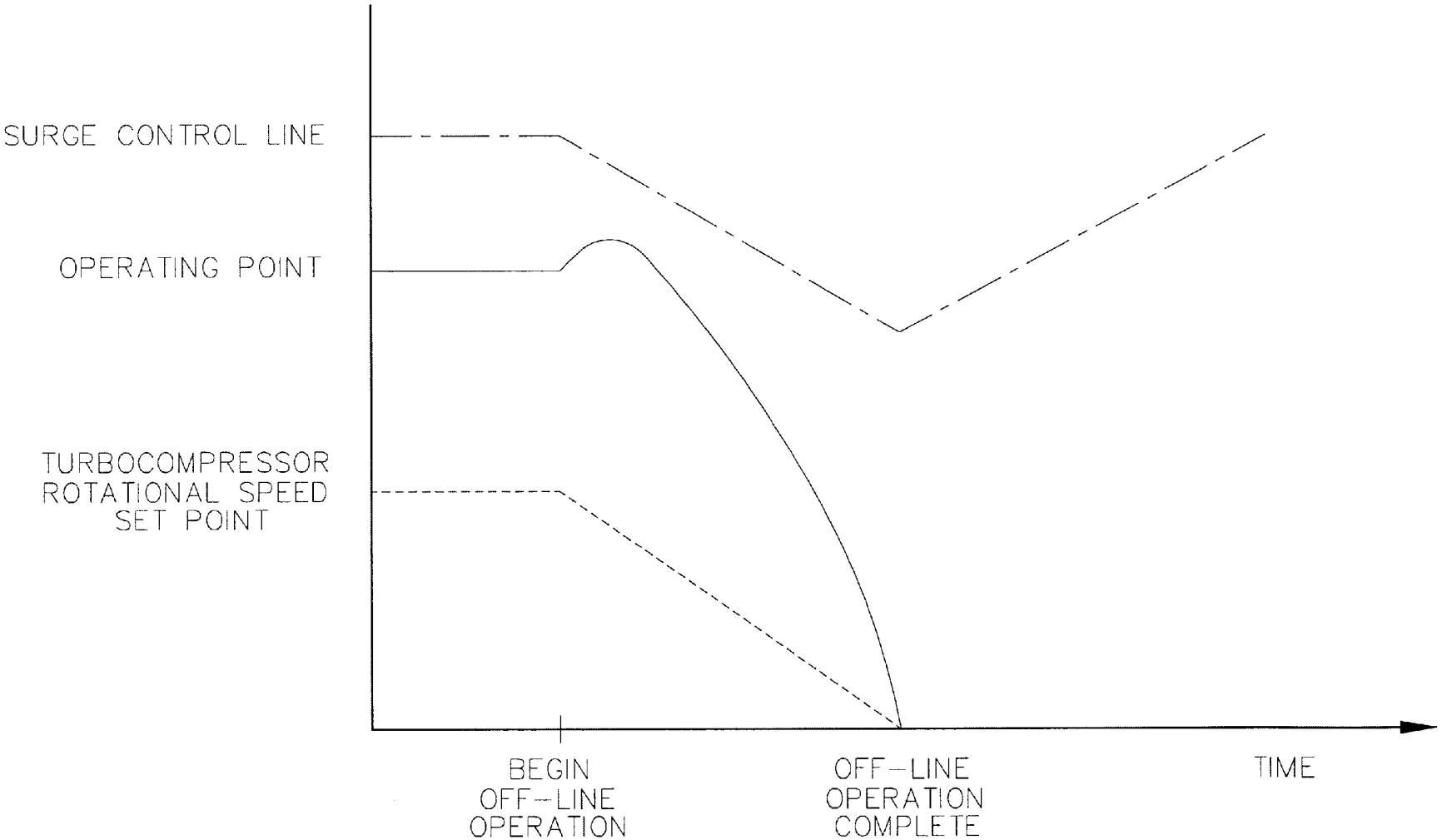
FIG. 4 shows the effect of the reduction of the compressor's rotational speed on the surge control line and operating point with respect to time, when the surge control line reaches its predetermined new location before being intercepted by the operating point.

Scenario 1 (see FIG. 4) The significance of Scenario 1 is that during reduction of the compressor's rotational speed, the surge control line will reach its predetermined new location before being intercepted by the operating point.

When the control line reaches its new location, the function block's 238 output will be set to a level equal to the second integrator's 222 input because the outputs of the second and third integrators 222, 224 change simultaneously. Following that, as soon as the operating point intercepts the surge control line, the antisurge controller 214 will instruct the recycle valve 131 to start opening. And, at the same time, the antisurge controller actuates the recycle-valve status block's 236 preset signal (inputted directly to the logic controller 228) that triggers a logic operation connecting the second integrator's 222 input with the function block's 238 output signal whose level now equals the level of the second integrator's 222 input signal source to which it was connected before being connected with the flnction block's 238 output.

As the second integrator's 222 output decreases, the ongoing reduction of the compressor's rotational speed (by way of the speed controller 226) will continue at a predetermined rate.

By satisfying the condition of the check valve 121 closure, and with further speed reduction, the pressure differential (Δp) across the check valve reaches a set point of the pressure-differential switch 234. This switch's signal (which corresponds to the check valve's closed position after an off-line operation) is transmitted to and processed by the logic controller 228 which, in turn, inputs to both the first and third integrators 220, 224 in order to return their output signals to prior values.

The reduction of compressor rotational speed will continue until reaching the speed comparator's 232 set point; subsequently, the second integrator 222 will disconnect from the logic controller, and the reduction of compressor rotational speed will cease.

Figure 5:
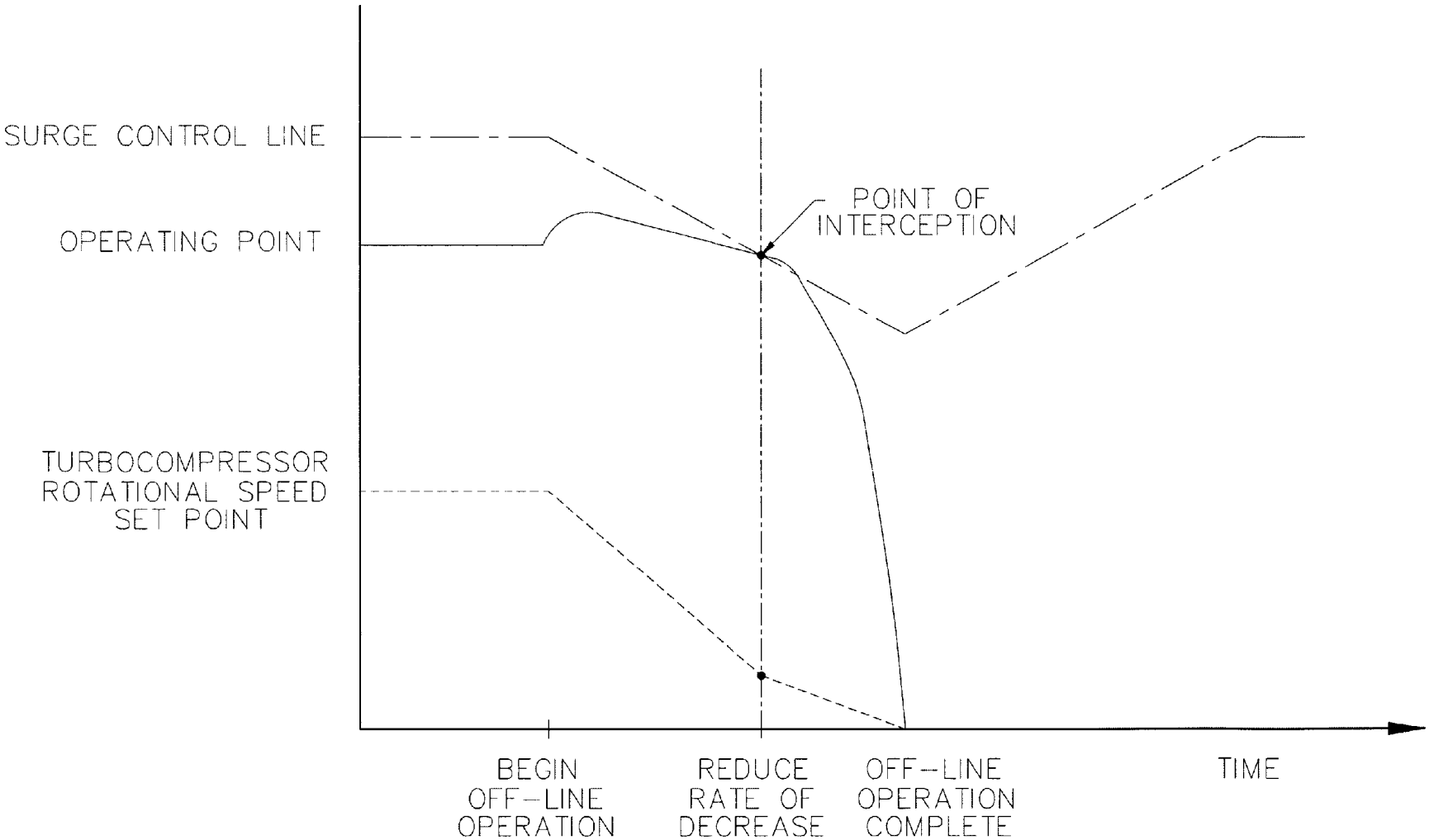
FIG. 5 shows the effect of the reduction of the compressor's rotational speed of the surge control line and operating point with respect to time, when the operating point intercepts the surge control line before the control line reaches its predetermined new location.

Scenario 2 (see FIG. 5) The significance of Scenario 2 is that during reduction of the compressor's rotational speed, its operating point intercepts the surge control line before the control line reaches its predetermined new location.

When the operating point 308 intercepts the control line, the recycle-valve status block 236 signal will input to the logic controller 228. This causes the function block 238 to initiate a logic operation linking the input of the second integrator 222 with the output of the flnction block 238, which is smaller than the input of the second integrator 222 before being linked to the function block 238. The resulting reduction of the second integrator's 222 output and the subsequent reduction of compressor speed will continue at a lower rate than before the operating point intercepted the surge control line. This lower rate is calculated as a function of the distance relationship (ratio) between (1) the surge control line's initial location 302 and its point-of-interception with the turbocompressor's operating point, and (2) the surge control line's initial location and its predetermined new location 306. In defining the slower deceleration rate (when the operating point is on the surge control line), the operating point is closer to the surge limit line than it would have been in Scenario 1.

The correlation between the output of the third integrator 224 and the deceleration rate (at the time the operating point intercepts the control line) is provided by the function block 238. The output signal of the third integrator ceases to change the deceleration rate, but the first integrator's 220 output continues to decrease, resulting in faster opening of the recycle valve 131.

The rate of deceleration will increase to its initial value with (1) the appearance of the pressure-differential switch 234 signal, (2) the disconnection of the second integrator 222 from the output of the function block 238, and (3)

linking the second integrator 222 with the signal source to which the second integrator's 222 input was connected before being connected with the function block's 238 output. Scenario 2 will be completed similarly to Scenario 1.

Other examples which can be used to indicate that the compressor has been successfully brought off-line are the following:

A preset compressor speed.

A preset recycle-valve position.

An expiration of the preset time delay.

Obviously, many modifications and variations of the present invention are possible in light of the above teachings. It is, therefore, to be understood that within the scope of the appended claims, the invention may be practiced otherwise than as specifically described.

We claim:

1. A method for preventing surge while taking a turbocompressor off-line from a parallel configuration, the method comprising:

(a) decreasing, at a preset rate, a set point value of the turbocompressor's rotational speed controller while taking said turbocompressor off-line; and (b) moving a surge control line, at a preset rate, from its initial location to a predetermined new location while taking said turbocompressor off-line.

2. The method of claim 1, wherein a signal is generated to indicate the turbocompressor is off-line.

3. The method of claim 2, wherein the surge control line is returned to its initial location based upon the receipt of said generated signal.

4. A method for preventing surge while taking a turbocompressor off-line from a parallel configuration, the method comprising:

(a) decreasing, at a preset rate, a set point value of the turbocompressor's rotational speed controller while taking said turbocompressor off-line;

(b) moving a surge control line, at a preset rate, from its initial location to a predetermined new location while taking said turbocompressor off-line;

(c) generating a signal upon detecting an interception of the surge control line and a turbocompressor's operating point; and (d) reducing the rate at which the speed set point is decreased when said signal is generated.

5. The method of claim 4, wherein a turbocompressor is taken off-line, further comprising: calculating a distance ratio that includes the distance between the surge control line's initial location and its location when intercepting the operating point, and the distance between the surge control line's initial location and its predetermined new location; and reducing the preset decreasing rate of the speed controller's set point value in accordance with the distance ratio.

6. The method of claim 4, wherein a signal is generated to indicate the turbocompressor is off-line.

7. The method of claim 6, wherein the off-line signal is used to return the speed controller's set point decreasing value to the preset rate of reduction.

8. The method of claim 4, wherein a generated signal returns the surge control line to its initial location.

9. An apparatus for preventing surge while taking a turbocompressor off-line from a parallel configuration, the apparatus comprising:

(a) means for decreasing, at a preset rate, a set point value of the turbocompressor's rotational speed controller while taking said turbocompressor off-line; and (b) means for moving a surge control line, at a preset rate, from its initial location to a predetermined new location while taking said turbocompressor off-line.

10. The apparatus of claim 9, wherein a signal is generated to indicate the turbocompressor is off-line.

11. The apparatus of claim 10, wherein the surge control line is returned to its initial location based upon the receipt of said generated signal.

12. An apparatus for preventing surge while taking a turbocompressor off-line from a parallel configuration, the apparatus comprising:

(a) means for decreasing, at a preset rate, a set point value of the turbocompressor's rotational speed controller while taking said turbocompressor off-line;

(b) means for moving a surge control line, at a preset rate, from its initial location to a predetermined new location while taking said turbocompressor off-line;

(c) means for generating a signal upon detecting an interception of the surge control line and a turbocompressor's operating point; and (d) means for reducing the rate at which the speed set point is decreased when said signal is generated.

13. The apparatus of claim 12, wherein a turbocompressor is taken off-line, fuller comprising: calculating a distance ratio that includes the distance between the surge control line's initial location and its location when intercepting the operating point, and the distance between the surge control line's initial location and its predetermined new location; and reducing the preset rate of the speed controller's set point decreasing value in accordance with the distance ratio.

14. The apparatus of claim 13, wherein a signal is generated to indicate the turbocompressor is off-line.

15. The apparatus of claim 14, wherein the off-line signal is used to return the speed controller's set point decreasing value to the preset rate of reduction.

16. The apparatus of claim 12, wherein a generated signal returns the surge control line to its initial location.

* * * * *

UNITED STATES PATENT AND TRADEMARK OFFICE

CERTIFICATE OF CORRECTION

PATENT NO. : 5,967,742

DATED : October 19, 1999

INVENTOR(S) : Saul Mirsky, et al.

It is certified that error appears in the above-identified patent and that said Letters Patent is hereby corrected as shown below:

Column 3, line 39, replace "$P_d/P_s$" with --$p_d/p_s$--

Column 6, line 39, replace "fuller" with --further--

Signed and Sealed this

Eighth Day of August, 2000

*Attest:*

*Attesting Officer*

Q. TODD DICKINSON

*Director of Patents and Trademarks*